US008813789B2

(12) United States Patent
Dalhart, Sr.

(10) Patent No.: US 8,813,789 B2
(45) Date of Patent: Aug. 26, 2014

(54) DISPENSER WITH INLINE PRESSURE REGULATOR

(75) Inventor: Mark Dalhart, Sr., Mason, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 126 days.

(21) Appl. No.: 12/184,496

(22) Filed: Aug. 1, 2008

(65) Prior Publication Data

US 2010/0024896 A1 Feb. 4, 2010

(51) Int. Cl.
*B01F 5/04* (2006.01)

(52) U.S. Cl.
CPC ..... *B01F 5/0413* (2013.01); *B01F 5/043* (2013.01)
USPC ..... 137/892; 137/895; 137/613; 251/366

(58) Field of Classification Search
USPC ..... 137/892, 895, 613; 251/366
See application file for complete search history.

(56) References Cited

U.S. PATENT DOCUMENTS 2,381,589 A * 8/1945 Hayes ..... 417/181
2,821,206 A * 1/1958 Holmes ..... 137/65
3,447,505 A * 6/1969 Wagner ..... 118/704
3,470,826 A * 10/1969 Foulds ..... 417/181
3,481,350 A * 12/1969 Chamberlain ..... 137/3
3,586,037 A * 6/1971 Zimmer ..... 137/505.18
3,760,982 A * 9/1973 Haase ..... 222/63
4,383,935 A * 5/1983 Hull ..... 261/78.1
4,396,356 A * 8/1983 Thompson ..... 417/186
5,269,337 A * 12/1993 Goldsmith ..... 137/78.3
5,427,151 A * 6/1995 Pauley ..... 137/895
6,634,376 B2 * 10/2003 Haas ..... 137/143
6,783,329 B2 * 8/2004 Vilela et al. ..... 417/189
6,789,563 B2 * 9/2004 Filkovski et al. ..... 137/102

* cited by examiner

*Primary Examiner* — Kevin Murphy
(74) *Attorney, Agent, or Firm* — Wood, Herron & Evans, LLP

(57) ABSTRACT

A proportioning dispenser of concentrated chemical mixed in a diluent such as water includes a water valve, an in-line water pressure regulator downstream of the valve and an eductor downstream of the regulator. When the valve is open, water flows to the regulator, and a pressure regulator water flow passes to the eductor. When the valve is closed, no water flows to the regulator, which sees pressurized water only when the water valve is open during a dispensing cycle. More accurate dilution ratios are achieved over a wide range of incoming water line pressures. In an alternate embodiment, a water valve and a regulator are formed in a common housing with the regulator operationally downstream of the valve.

7 Claims, 4 Drawing Sheets

DISPENSER WITH INLINE PRESSURE REGULATOR

This invention relates to proportioning dispensers requiring accurate dilution over a wide range of incoming water pressures.

Proportioning dispensers are well known. In such a dispenser, water is passed through a backflow preventor or vacuum breaker to an eductor. The water flow is directed through a venturi having a port operably connected to a source of concentrated chemical. Suction created by the water flow through the venturi draws the chemical into the water flow where it mixes with the water at a predetermined ratio and the mixture is thereafter discharged. A plurality of selectable chemical sources, source selector valves, mix ratios and other features may be used in particular applications.

In the past, two different systems for regulating water pressure presented to the dispenser have been used. In one, the pressure regulator is oriented upstream of the water valve where it is constantly subjected to incoming water pressure, whether the water valve is "on" or "off". Such prior regulators tend to leak, particularly after exposure for a time to water pressure. This is exacerbated where pressure is relatively high, such as 80 to 85 psi and higher. Such leakage can cause expensive flooding, particularly when not immediately observed, such as during off-shift hours, weekends, holidays and the like. Moreover, the capacity of the regulators to produce a water flow at a constant pressure from a varying pressure source can be comprised by a regulator constantly exposed to incoming pressure.

Another disadvantage is that the devices downstream of the regulator further act on the water flow, potentially disrupting the uniformity of the regulated flow. In particular, the water valve and other devices downstream of the pressure regulator are attended by their own pressure drops and other parameters varying the flow so that the water pressure presented to the eductor is either inconsistent or not at the pressure set up by the upstream regulator.

In another prior system, flow washers or restrictors have been used to control rate of flow to eductors. However, such flow regulators, while operating acceptably at lower flow rates such as in the one gallon per minute range, do not do so well at higher rates, such as on the range of three gallons per minute or more. Maintenance of desired constant or linear dilution ratios of water to chemical concentrate is thus inconsistent.

While more expensive pressure or flow regulators could be used, such expenses run the cost of the proportioner systems to unacceptably high levels.

Accordingly, it is one objective of the invention to provide a regulated water supply to a proportioning dispenser without the use of flow washers or restrictors and without the disadvantages of a constantly pressurized pressure regulator.

A further objective of the invention has been to provide an improved proportioning dispenser with improved water pressure control.

A further objective of the invention has been to provide an improved apparatus and methods or controlling water flow through a proportioning dispenser.

A further objective of the invention has been to provide a proportioning dispenser providing accurate dilution control over a wide range of incoming water line pressures.

To these ends, the invention contemplates in one embodiment a proportioning dispenser including a water inlet, a water valve, an inline water pressure regulator downstream of said water valve and upstream of a chemical eductor.

With the regulator downstream of the water valve, the regulator is subjected to water pressure only when the water valve is "on" during dispensing and not when it is "off". Moreover, the regulator in this disposition between the water valve and the eductor provides more consistent water flow over a wider range of parameters than flow regulators previously had.

Disposition of a pressure regulator between any water valve and the eductor negates any pressure variations introduced by the water valve, thus rendering more consistent and predictable the pressure of the incoming water introduced to the eductor. This more consistent pressure control provides for more consistent dilution accuracy in a proportioning dispenser.

Accordingly, this invention serves at the same time to reduce leakage, while providing a more linear dilution ratio over a wide range of flow rates (e.g. 1 to 3 gallons per minute and higher) at a wide range of water pressures from lower than 30 psi through 120 psi or higher.

These and further objectives and advantages will be readily appreciated from the following written description and from the drawings in which:

DETAILED DESCRIPTION OF A PREFERRED EMBODIMENT

Figure 1:
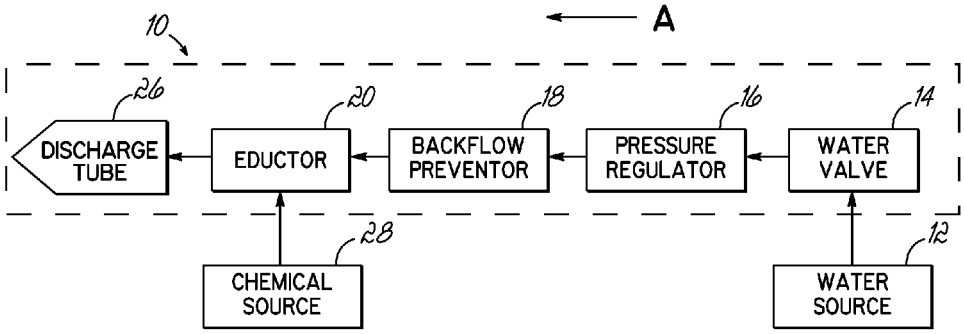
FIG. 1 is a chart illustrating a proportioning dispenser apparatus according to the invention in flow-chart format.
Figure 2:
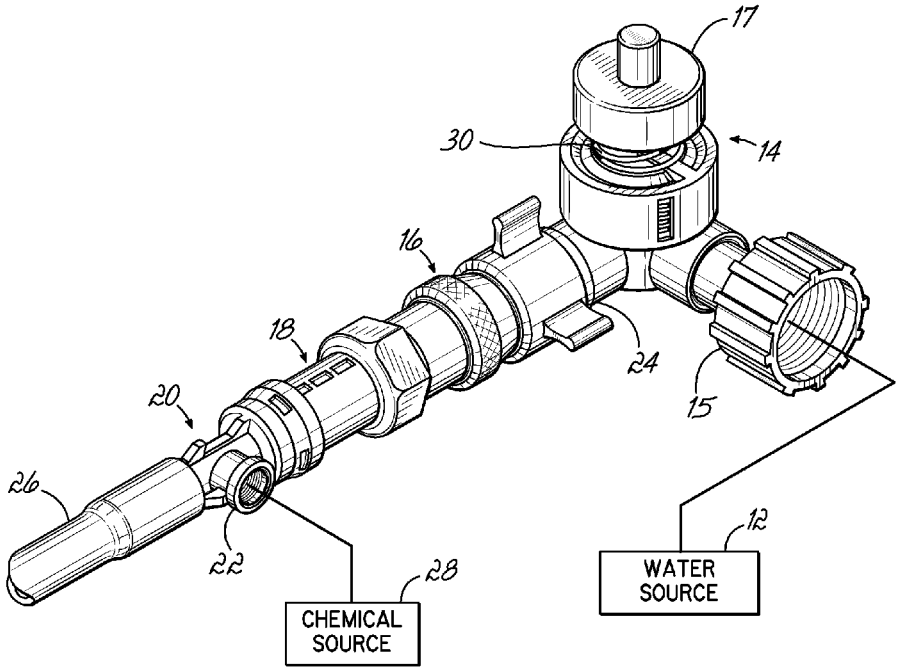
FIG. 2 is an illustration of a proportioning dispenser as in FIG. 1 but illustrating the physical features of the invention as they may appear in an actual dispenser according to the invention.

Turning now to FIGS. 1 and 2, FIG. 1 illustrates the invention in flow chart form. Moving from right to left in FIG. 1, a dispenser 10 receives water from a source 12 of water under pressure. A water valve 14 is movable between "on" and "off" positions, and dispenser 10 further includes an inline pressure regulator 16, a backflow preventor 18 and an eductor 20.

While water source 12 is illustrated to indicate the diluent delivered to dispenser 10 is water, it will be appreciated that another fluid diluent under pressure might be used in an appropriate situation.

Water valve 14 is any suitable valve having at least "on" or open and "off" or closed positions. When "on", water is passed through valve 14 in a downstream direction (arrow A). When valve 14 is "off", flow of water from source 12 is interrupted and no water flows downstream of valve 14.

Pressure regulator 16 is operably connected to receive water flow from valve 14, to regulate pressure of water flowing through the regulator 16 downstream to backflow preventer 18. Regulator 16 may be any suitable type of pressure regulator capable of receiving water from source 12 at predetermined source pressures or pressure ranges, and of regulating the pressure of water discharging from regulator 16. While a variety of regulators 16 may be used, one particular regulator 16 which has been found useful is the regulator marketed by the Camco Company of Greensboro, N.C., under the model name or designation Camco Model 40052.

It will be appreciated that when valve 14 is "off", no water is introduced to regulator 16. During these "off" times, no pressure is presented to regulator 16 and its respective seals and components are not pressurized. As a result, the regulator 16 need not be as robust or as expensive as would be required if the regulator was upstream of valve 14 and was constantly subjected to incoming water pressure.

A backflow preventer 18 is operably connected to regulator 16, when valve 14 is "on", water at regulated pressure flows into backflow preventer 18. Preventor 18 serves to prevent backflow of water or of chemical toward source 12 in the event of a water pressure system reversal. Contamination of source 12 is thus prevented. Backflow preventer 18 may be of any suitable type, such as those shown in U.S. Pat. Nos. 6,634,376; 5,159,958; 5,253,677; 5,522,419 or 5,862,829, for example, said patents herewith expressly incorporated herein by reference.

From backflow preventor 18, water flows to eductor 20. that eductor is of any suitable type, and preferably includes a venturi (not shown) for drawing a selected chemical into the water flow where water and chemical are mixed, then discharged. Such eductors and venturis may be, for example, of the type shown in U.S. Pat. Nos. 6,634,376; 5,159,958; 5,377,718; 5,522,419, 5,653,261 and 5,862,829, each of which is herewith expressly incorporated herein by reference.

Referring now to FIG. 2, components of dispenser 10 as they may appear in physical embodiment are illustrated. A water source 12 is connected to an inlet 15 of a water valve 14. Valve 14 has a discharge outlet 24 operably connected to inline pressure regulator 16. Regulator 16 is in turn operably connected to backflow preventor 18, which is in turn operably connected to eductor 20. Eductor 20 has a discharge tube 26 for discharging the water and chemical mix. Eductor 20 is provided with at least one chemical inlet port 22 for operable connection to a source 28 of concentrated chemical. Alternately, eductor 20 may be provided with a plurality of chemical inlets 22, or with a selector valve for selecting and providing a selected chemical to eductor 20.

With respect to water valve 14, it will be appreciated that valve has a manually operable, magnetic button 17 capable of opening valve 14 when depressed toward valve 14 and when released, moving away under bias of spring 30 and thus closing valve 14 to stop flow of water from source 12 to regulator 16. While any suitable water valve may be used, one such valve is that marketed by Invensys Controls of Carol Streams, Ill., as Model K-74197.

Accordingly, when connected to a water source, dispenser 10 is functional to discharge a mix of water and chemical upon depression of button 17 and opening of valve 14. Water flows from source 12 through valve 14, regulator 16, preventer 18 and eductor 20 to draw chemical from source 28 into the water flow and to discharge the mix.

When the button 17 is released, it rebounds, closing valve 14 and interrupting water flow to regulator 16 and downstream. When "off" or closed, valve 14 prevents water from source 12 from reaching regulator 16. During the time valve 14 is closed, regulator 16 is not exposed to pressure from source 12. Less expensive and more flexible inline pressure regulators can thus be used, providing enhanced accuracy for pressure regulation across a range in input pressures presented to regulator 16 when valve 14 is open.

Moreover, a dispenser according to the invention is capable of providing more linear dilution ratios, up to about 120 psi input source pressure, than in prior systems with regulators constantly subjected to input pressures whether the dispenser is "on" or "off".

In an alternate embodiment, a pressure regulator is formed as a unit with the body of the water valve and is disposed downstream of the water valve. Such an embodiment is shown in FIGS. 3-6 where water valve parts similar to those of water valve 14 are similarly numbered with an "A" suffix.

The advantages provided are the same as noted above and with the additional advantage of reduced length of the overall dispenser since the regulator is not a separate component, but, rather, an integral space-saving component of the water valve itself.

Figure 3:
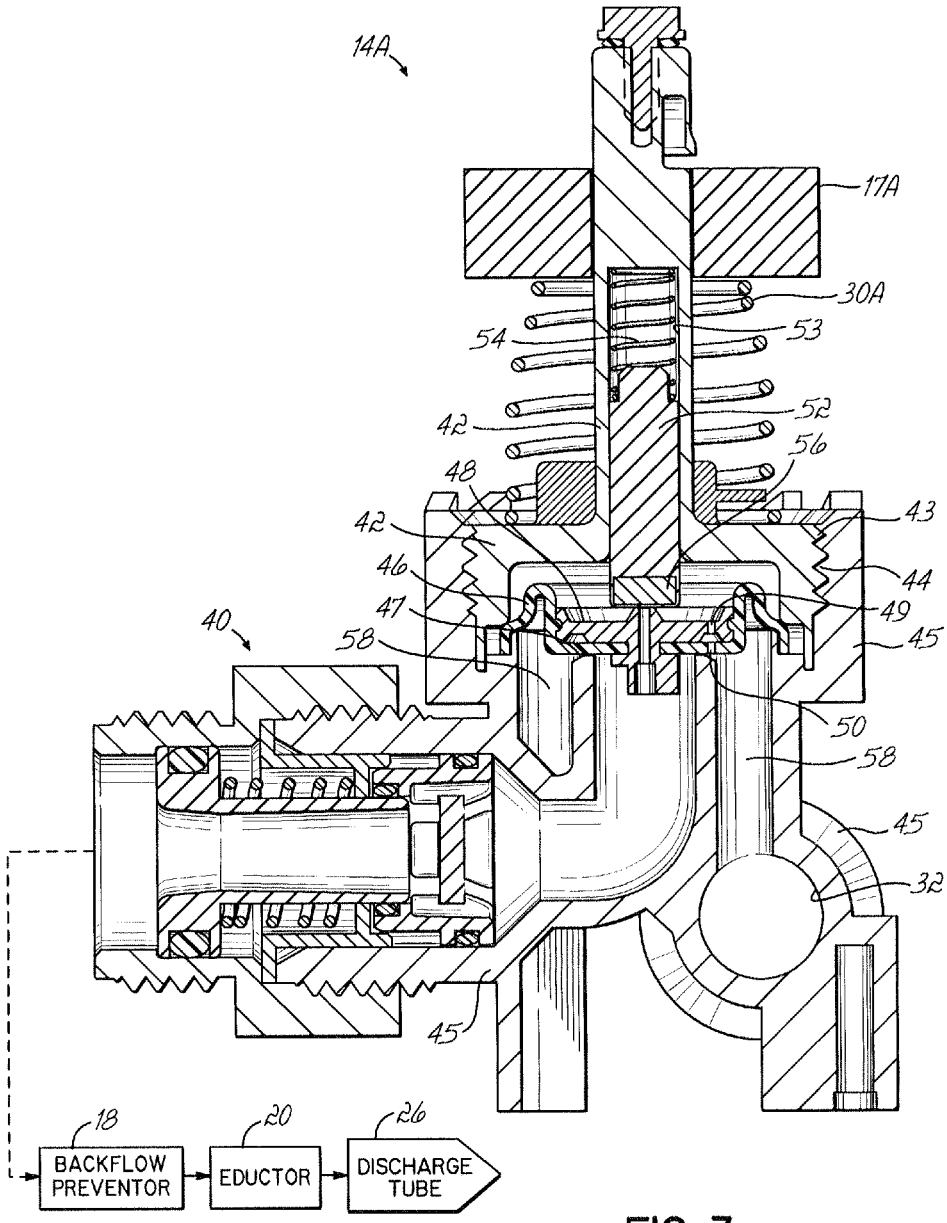
FIG. 3 is an illustration in cross-section of an alternate embodiment of the invention showing the wetter valve closed with no water flow to the regulator.
Figure 4:
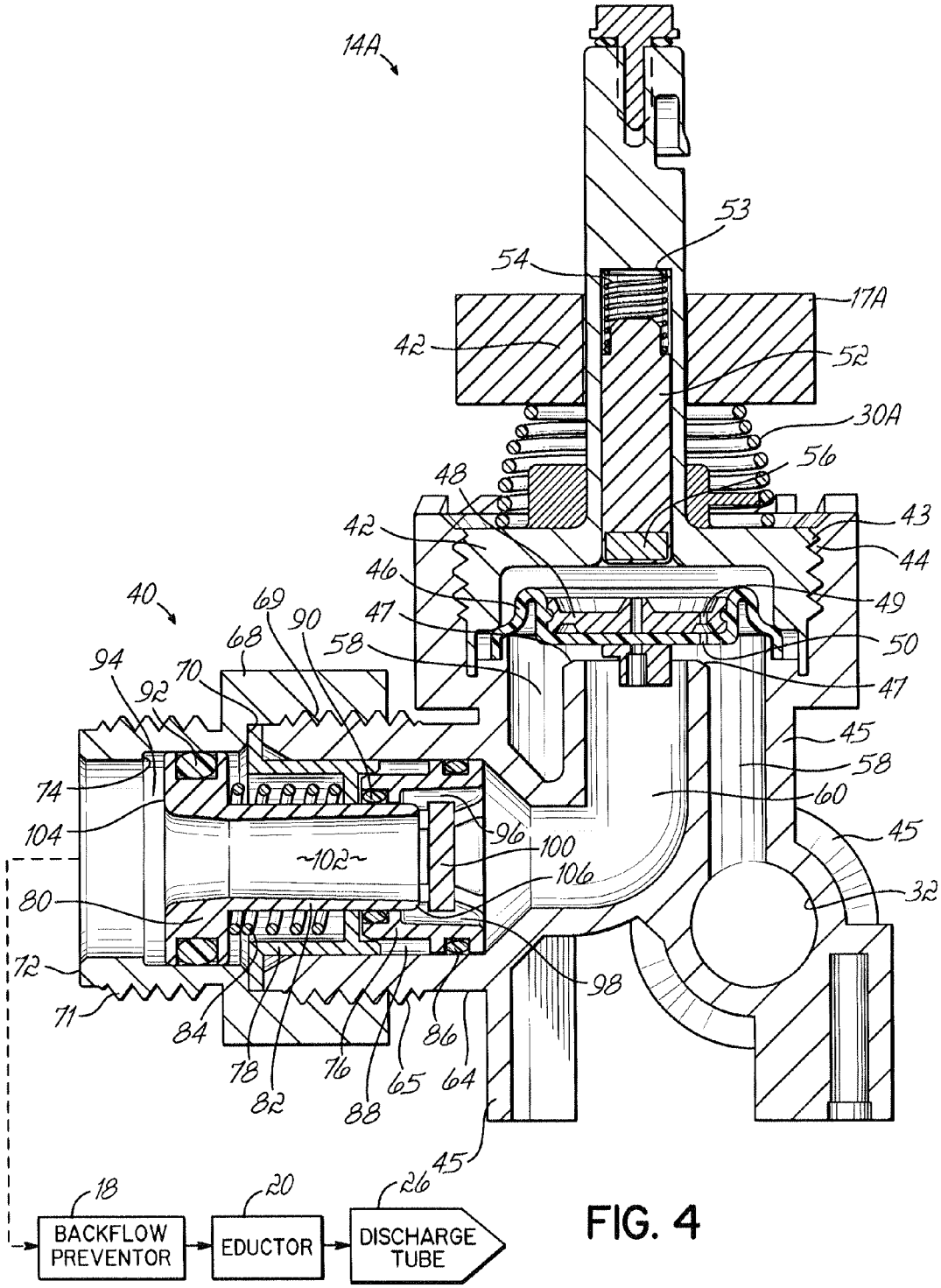
FIG. 4 is a view similar to FIG. 3 but showing the water valve open with water flow to the regulator.
Figure 5:
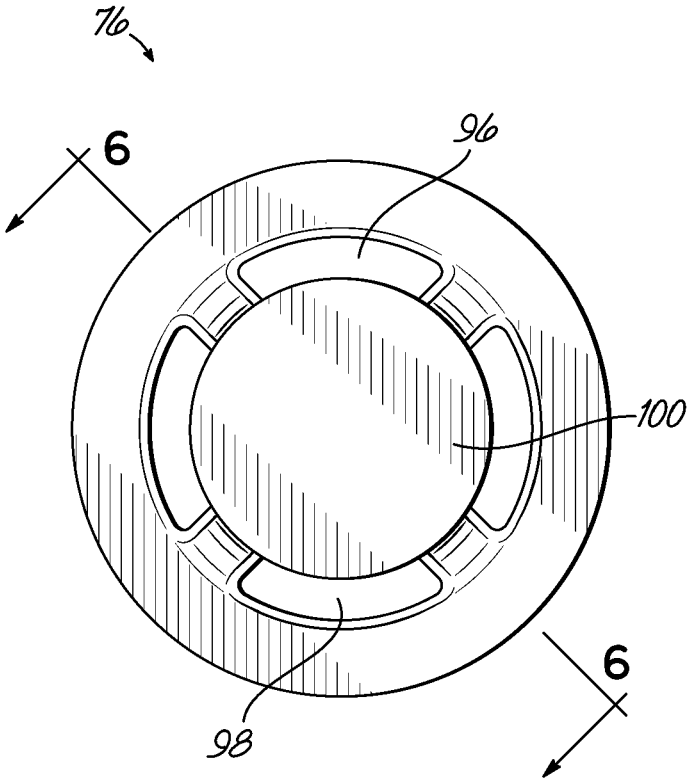
FIG. 5 is an end view of throttle member 76.
Figure 6:
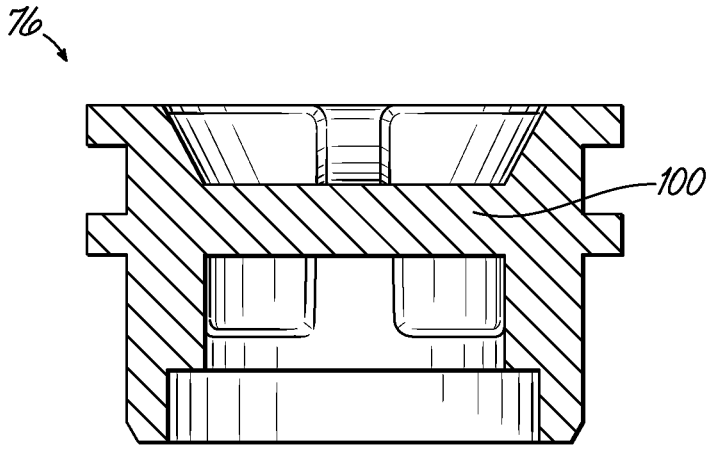
FIG. 6 is a cross-section view taken along lines 6-6 of FIG. 5.

Turning to FIGS. 3 and 4, a water valve 14A is shown and similarly to valve 14, includes a push button moveable magnet 17A biased outwardly by a spring 30A. Motion of magnet 17A in toward valve 14A opens the valve to pass water under pressure in inlet passage 32 to a pressure regulator 40.

Water valve 14A has a body 42 and is secured in valve body 42 by external threads 43 on body 12 received in the internal threads 44 of housing 45.

A diaphragm 46 is operably disposed between body 42 and a seat 47 of housing 45. A diaphragm insert 48 is operably connected to diaphragm 46 and among other features includes a bleed hole 49 in operative communication with a bleed hole 50 in diaphragm 46. There are preferably a plurality of corresponding bleed holes 49, 50 about a center of the circular, rolling diaphragm 46.

An armature 52 is located in bore 53 of valve body 42. Armature 52 is biased downwardly, or toward diaphragm 46 by a spring 54. Lower end 45 of armature 52 engages and urges insert 48 and diaphragm 46 toward and into seat 47 of housing 45. Water introduced through inlet or passage 32 (lows into area 58 upstream of seat 47 through appropriate passages in housing 45. No flow is permitted by the diaphragm 46/seat 47 engagement when the valve is closed When flow through valve 41A is desired, magnet 17A is pushed toward the armature 52 as shown in FIG. 4. Movement of magnet 17A toward armature 52 pulls armature 52 upwardly or away from diaphragm 46 to a position as illustrated in FIG. 4. This relieves the bias of armature 52 or insert 48 by spring 54, whereupon water pressure in areas 58 is sufficiently great to lift diaphragm 46 from seat 47. This allows water to flow past seat 47 to passage 60 toward regulator 40.

Bleed holes 49, 50 facilitate diaphragm 46 separately from seat 47 by bleeding or allowing water at pressure above the diaphragm 46 to bleed back into the main water flow, relieving any pressure above the diaphragm which might otherwise resist opening of valve 14A.

Valve 14A thus remains open so long as magnet 17A retains armature 52 in a raised position above diaphragm 46 against bias of spring 54.

When the valve 14A is to be closed, magnet 17A is retracted by release of magnet 17A or any opening bias thereon so that spring 30A can retract the magnet. Movement of the magnet 17A away from armature 52 releases it to the bias of spring 54, which drives it downwardly at the same time as pressurized water bleeds through holes 49, 50 to an area above diaphragm 46, seating it on seat 47 and closing the valve 14A.

Turning now to regulator 40, it will be appreciated that it is formed in housing 45, as is valve 14A, but operationally downstream thereof. Regulator 40 is secured in an integral, externally threaded projection 64 of housing 45 having external threads 65. A retainer nut 68 has internal threads 69 for engaging threads 65 to secure the components of regulator 40 in projection 64. Nut 68 defines a retaining shoulder 70 and externally threaded 71 projection 72 for connection to a downstream component such as a backflow preventor 18 (FIG. 2). Nut 68 also defines a radially inwardly projecting shoulder 74.

Regulator 40 further includes a throttle member 76 (see FIGS. 5 and 6), a retainer 78, a piston 80 having a sleeve 82 and a spring 84, each part preferably interrelated to the other as shown. O-ring 86 seals throttle member 76 to bore 88 of housing 45. O-ring 90 moveably seals throttle member to sleeve 82. O-ring 92 seals piston 80 to inside bore 94 of nut 68.

Throttle member 76 (FIGS. 5 and 6) defines radially positioned slots 96, 98 around disc 100 which restricts direct water flow through regulator 40. Instead, water flows through radial oriented slots 96, 98 (of which there may be more than two) and into bore 102 of sleeve 82 and piston 80. From there, water flows outwardly of nut 68 to any downstream component such as backflow prevent or 18.

Once water pressure backs up to nut 68, pressure on face 104 of piston 80 urges piston 80 away from shoulder 74 against spring 84. The end 106 of sleeve 82 partially closes slots 96, 98, having the effect of reducing water flow through regulator 40 and thus regulating the pressure of water flowing through regulator 40.

Piston 80 tends to cycle or move dynamically, back and forth, seeking an equilibrium and thus regulating water pressure as a function, in part, of the cross-section area of face 104, and bias of spring 84, providing a pressure regulated water supply downstream of regulator 40.

Desired pressure can be produced by variations in piston face (104) cross-section and in the parameters of spring 84.

Such a configuration provides a unique water valve and regulator combination which is of substantially smaller configuration than when water valve and regulator are of two component structures. Meanwhile, the foregoing benefits of a downstream pressure regulator are retained, producing more consistent pressure regulation for a wide variety of incoming pressures, and limiting exposure of the regulator to only those times when the water valve is selectively opened.

These and other modifications, will become readily apparent from the foregoing to one of ordinary skill in the art without departing from the scope of the invention and applicant intends to be bound only by the claims appended hereto.

What is claimed is:

1. A dispenser for dispensing water-diluted chemicals for use, said dispenser including, in combination, an integral one-piece housing having a discharge outlet, a backflow preventer operably connected to said discharge outlet and having a downstream end a chemical eductor operably connected to the downstream end of said back flow preventer and for drawing concentrated chemical into a water flow passing through said eductor for dilution and discharge, said combination further comprising, in said integral one-piece housing, a valve seat defined by said housing;

a water valve operably disposed for selective engagement with said seat for selectively blocking or passing water past said seat;

a first water bore extending in a first direction in said housing and operably communicating with said valve of upstream of said seat;

a second water bore defined in said housing and extending in a second direction in said housing from a first end of said second water bore proximate to and operatively communicating with said seat, to a second downstream end of said second water bore;

a third water bore defined in said housing and extending in a third direction in said housing to said discharge outlet of said housing, said third water bore having an upstream first end operably communicating with said second downstream end of said second water bore, a pressure regulator disposed within said third water bore for receiving water from said second bore and passing water at a selected pressure downstream from said regulator and said discharge outlet to said backflow preventer;

said first and third water bores extending respectively in said first and third directions perpendicular to each other;

said first direction extending perpendicularly to said second direction; and said third direction extending perpendicularly to said second direction.

2. A dispenser as in claim 1 wherein said second water bore is smaller in diameter than said third water bore.

3. A dispenser as in claim 1 wherein said housing surrounds said valve seat and has an interior threaded portion for receiving said water valve above said first end of said second water bore.

4. A dispenser as in claim 1 further including an externally threaded section of said housing about said discharge outlet of said housing.

5. A dispenser as in claim 4 further including a retainer on said externally section about said third bore and holding said pressure regulator within said third bore.

6. A dispenser as in claim 5 wherein said retainer includes and externally threaded section downstream of said discharge outlet of said housing.

7. A dispenser as in claim 1 wherein said backflow preventer and said eductor are disposed outside said integral, one-piece housing.

* * * * *